US006415628B1

(12) United States Patent
Ahmed et al.

(10) Patent No.: US 6,415,628 B1
(45) Date of Patent: Jul. 9, 2002

(54) SYSTEM FOR PROVIDING DIRECT CONTACT REFRIGERATION

(75) Inventors: M. Mushtaq Ahmed, Pittsford; Theodore Fringelin Fisher, West Amherst, both of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/911,766

(22) Filed: Jul. 25, 2001

(51) Int. Cl.[7] ..... B01D 9/04

(52) U.S. Cl. ..... 62/534; 62/434; 62/613; 62/619; 62/908

(58) Field of Search ..... 62/533, 534, 434, 62/613, 619, 908

(56) References Cited

U.S. PATENT DOCUMENTS 3,803,860 A * 4/1974 Nagashima et al. ..... 62/534
4,452,621 A * 6/1984 Fowles et al. ..... 62/534
4,481,780 A 11/1984 Delano ..... 62/52
4,596,120 A * 6/1986 Knodle et al. ..... 62/534
4,914,166 A 4/1990 Kennedy et al. ..... 526/61
5,362,455 A 11/1994 Cheng ..... 422/253
5,394,827 A 3/1995 Cheng ..... 117/206
5,444,986 A * 8/1995 Hino ..... 62/534
5,483,806 A 1/1996 Miller et al. ..... 62/402
5,718,116 A 2/1998 Grassi et al. ..... 62/62
5,724,832 A * 3/1998 Little ..... 62/613
5,763,544 A 6/1998 Chen et al. ..... 526/78
5,943,869 A 8/1999 Cheng et al. ..... 62/121
6,041,620 A * 2/2000 OLzewski et al. ..... 62/613
6,298,688 B1 * 10/2001 Brostow et al. ..... 62/613

* cited by examiner

*Primary Examiner*—Ronald Capossela
(74) *Attorney, Agent, or Firm*—Stanley Ktorides

(57) ABSTRACT

A method and apparatus for providing direct contact refrigeration to a heat source wherein refrigeration is generated using a recirculating defined multicomponent refrigerant fluid, and transferred to a direct contact refrigerant fluid which directly contacts the heat source.

18 Claims, 3 Drawing Sheets

SYSTEM FOR PROVIDING DIRECT CONTACT REFRIGERATION

TECHNICAL FIELD

This invention relates generally to the generation of refrigeration and the provision of the refrigeration by direct contact with a heat source.

BACKGROUND ART

Refrigeration to provide cooling and/or freezing duty to a heat source is widely required in industrial processes such as in the cooling of exothermic reactors and the cooling of crystallizers. This refrigeration may be provided by indirect heat exchange of the refrigerant with the heat source. Direct contact heat exchange of the refrigerant with the heat source is advantageous because the heat exchange is more efficient than indirect heat exchange but such direct contact heat exchange adds complexity to the system. Moreover conventional direct contact refrigeration provision systems are characterized by high costs to generate the requisite refrigeration.

Accordingly, it is an object of this invention to provide an improved method for providing direct contact refrigeration wherein the requisite refrigeration may be generated with lower power costs than conventional systems.

SUMMARY OF THE INVENTION

The above and other objects, which will become apparent to those skilled in the art upon a reading of this disclosure, are attained by the present invention one aspect of which is:

A method for providing direct contact refrigeration comprising:

(A) compressing a multicomponent refrigerant fluid comprising at least two components from the group consisting of hydrocarbons having from 1 to 6 carbon atoms, fluorocarbons having from 1 to 6 carbon atoms, and inert gases;

(B) cooling the compressed multicomponent refrigerant fluid, expanding the cooled compressed multicomponent refrigerant fluid to generate refrigeration, and warming the refrigeration bearing multicomponent refrigerant fluid by indirect heat exchange with said cooling compressed multicomponent refrigerant fluid and also by indirect heat exchange with clean direct contact refrigerant to produce cold direct contact refrigerant;

(C) contacting the cold direct contact refrigerant with a heat source to cool the heat source producing warmed direct contact refrigerant which contains contaminants from the heat source; and (D) treating the direct contact refrigerant to remove contaminants and to produce clean direct contact refrigerant for indirect heat exchange with the refrigeration bearing multicomponent refrigerant fluid.

Another aspect of the invention is:

Apparatus for providing direct contact refrigeration comprising:

(A) a multicomponent refrigerant circuit comprising a compressor, a heat exchanger, an expansion device, means for passing multicomponent refrigerant fluid from the compressor to the heat exchanger, from the heat exchanger to the expansion device, from the expansion device to the heat exchanger, and from the heat exchanger to the compressor;

(B) a heat source, means for passing direct contact refrigerant to the heat exchanger, and means for passing direct contact refrigerant from the heat exchanger to the heat source;

(C) a cleaning device, means for passing direct contact refrigerant from the heat source to the heat exchanger and means for passing direct contact refrigerant from the heat exchanger to the cleaning device; and (D) means for passing direct contact refrigerant from the cleaning device to the heat exchanger.

As used herein, the term "indirect heat exchange" means the bringing of two fluids into heat exchange relation without any physical contact or intermixing of the fluids with each other.

As used herein, the term "contaminants" means one or more substances which will adulterate the direct contact refrigerant used in the method of this invention.

As used herein, the term "inert gases" means nitrogen, carbon dioxide and noble gases such as helium and argon.

DETAILED DESCRIPTION

Figure 1:
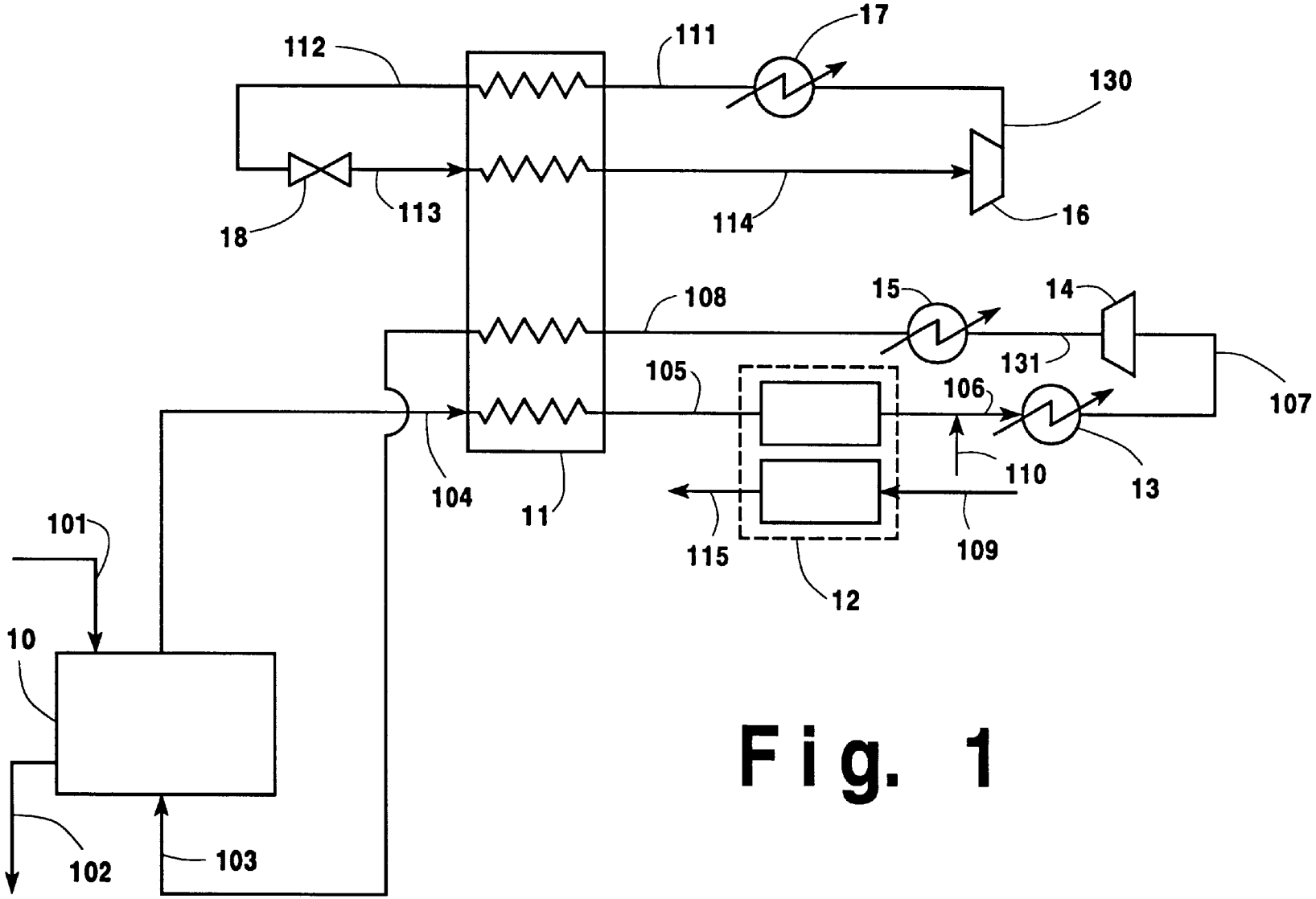
FIG. 1 is a simplified schematic representation of one preferred embodiment of the direct contact refrigeration method of this invention.

The invention will be described in detail with reference to the Drawings. Referring now to FIG. 1, multicomponent refrigerant fluid 114 is compressed to a pressure generally within the range of from 30 to 500 pounds per square inch absolute (psia) by passage through compressor 16. Resulting compressed multicomponent refrigerant fluid 130 is cooled of the heat of compression in aftercooler 17 and then passed in stream 111 to heat exchanger 11.

The multicomponent refrigerant fluid useful in the practice of this invention comprises two or more components which can be hydrocarbons having from 1 to 6 carbon atoms, fluorocarbons having from 1 to 6 carbon atoms, and inert gases. Examples of hydrocarbons having from 1 to 6 carbon atoms include methane, ethane, ethylene, propane, propylene, n-butane, n-pentane and n-hexane. Examples of fluorocarbons having from 1 to 6 carbon atoms include tetrafluoromethane, perfluoroethane, fluoroform, pentafluoroethane, difluoromethane, chlorodifluoromethane, and trifluoromethoxy-perfluoromethane. The multicomponent refrigerant fluid useful in the practice of this invention may comprise a mixture of solely hydrocarbons or a mixture of solely fluorocarbons, or may comprise a mixture of one or more hydrocarbons and one or more fluorocarbons, a mixture of one or more hydrocarbons and one or more inert gases, a mixture of one or more fluorocarbons and one or more inert gases, or a mixture having at least one hydrocarbon, at least one fluorocarbon, and at least one inert gas.

The compressed multicomponent refrigerant fluid 111 is cooled in heat exchanger 11 by indirect heat exchange with warming refrigeration bearing multicomponent refrigerant fluid, as will be more fully described below, to produce cooled compressed multicomponent refrigerant fluid 112 which may be entirely in the vapor phase or may be partially or totally condensed. Cooled compressed multicomponent refrigerant fluid 112 is expanded to generate refrigeration. The embodiment of the invention illustrated in FIG. 1 is a preferred embodiment wherein the expansion is an isenthalpic expansion through Joule-Thomson valve 18. The resulting refrigeration bearing multicomponent refrigerant fluid 113 is warmed by passage through heat exchanger 11 to provide the aforesaid cooling of the compressed multicomponent refrigerant fluid and is then passed in stream 114 to compressor 16 and the multicomponent refrigerant fluid refrigeration cycle begins anew.

Clean direct contact refrigerant 108 is cooled by indirect heat exchange with warming multicomponent refrigerant fluid preferably, as shown in FIG. 1, by passage through heat exchanger 11 which is a unitary piece. Alternatively, heat exchanger 11 could comprise more than one piece with the multicomponent refrigerant fluid autorefrigeration occurring in one piece and other heat exchange steps occurring in one or more other pieces. Most or all of multicomponent refrigerant fluid 113 which is in the liquid phase is vaporized by the indirect heat exchange with the compressed multicomponent refrigerant fluid and the clean direct contact refrigerant. The indirect heat exchange with the warming refrigeration bearing multicomponent refrigerant fluid results in the production of cold direct contact refrigerant 103. Preferably the direct contact refrigerant comprises nitrogen. The direct contact refrigerant may be comprised of one or more components. Other components which may comprise the direct contact refrigerant useful in the practice of this invention include argon and helium. The direct contact refrigerant is such that it does not contaminate the process fluid or other heat source that it cools by direct contact.

Cold direct contact refrigerant 103 is provided in gaseous and/or liquid form to a process or system which requires refrigeration, shown in representation form in FIG. 1 as item 10. Examples of such systems or processes include exothermic reactors and direct contact crystallizers.

Refrigeration requiring system or process 10 has a heat source, shown in FIG. 1 as input 101, which receives refrigeration by direct contact with cold direct contact refrigerant 103, resulting in refrigerated fluid or other substance 102. The heat source is a source of contaminants for the direct contact refrigerant. Direct contact refrigerant 104 leaves process or system 10 as a vapor containing one or more contaminants such as chemical species which it picks up as a result of directly contacting heat source 101. For example in a paraxylene crystallization process, the contaminants in stream 104 may include input 101 constituents such as paraxylene, metaxylene, orthoxylene and ethylbenzene.

Contaminant containing direct contact refrigerant 104 is passed to heat exchanger 11 wherein it is warmed by indirect heat exchange with the cooling clean direct contact refrigerant and the resulting warmed contaminant containing direct contact refrigerant 105 is cleaned of contaminants in a cleaning device. The embodiment of the invention illustrated in FIG. 1 is a preferred embodiment wherein the cleaning device is an adsorption unit and the contaminant containing direct contact refrigerant is cleaned of contaminants by passage through one of two beds of adsorption system 12. The beds contain suitable adsorbent material such as zeolite molecular sieve to remove contaminants by adsorption onto the adsorbent as the direct contact refrigerant passes through the bed, emerging therefrom as clean direct contact refrigerant 106. When the adsorbent bed becomes loaded with contaminants the flow of contaminant containing direct contact refrigerant is directed into the other bed while the loaded bed is cleaned by the passage therethrough of purge gas, shown in FIG. 1 as streams 109 and 115. This continues until the adsorbing bed becomes loaded with contaminants whereupon the flows are changed again. The adsorption system continues cycling in this manner.

If desired, make-up direct contact refrigerant 110 may be added to clean direct contact refrigerant 106 to make up for the loss of refrigerant in the direct contacting of the heat source. The clean direct contact refrigerant is cooled in cooler 13 and passed in stream 107 of compressor 14 wherein it is compressed to a pressure generally within the range of from 50 to 400 psia. Resulting compressed clean direct contact refrigerant 131 is cooled of the heat of compression in aftercooler 15 and then passed in stream 108 to heat exchanger 11 for indirect heat exchange with the refrigeration bearing multicomponent refrigerant fluid and then is recycled to provide further direct contact refrigeration to the heat source.

The following example is provided for illustrative purposes and is not intended to be limited. In this example the process or system which requires refrigeration is the direct contact cryogenic crystallizer system disclosed in U.S. Pat. Nos. 5,362,455—Cheng and 5,394,827—Cheng, the direct contact refrigerant is nitrogen, and the multicomponent refrigerant fluid is a mixture of 14 mole percent methane, 40 mole percent ethylene, 28 mole percent propane, 4 mole percent n-butane, 6 mole percent n-pentane and 8 mole percent n-hexane. The refrigeration load is one million BTU/hr. The numerals refer to those of FIG. 1.

Mixed xylenes 101 (mixture of paraxylene (p-xylene), metaxylene (m-xylene) and orthoxylene (o-xylene) with minor quantities of other hydrocarbons) and cold nitrogen gas 103 are fed to direct contact crystallization system 10. The cold nitrogen gas 103 is supplied at a temperature 5° F. to 100° F. below the crystallizer operating temperature. The cold nitrogen gas is supplied at a pressure which is 5 to 50 psi, and preferably 5 to 15 psi above the crystallizer operating pressure to ensure adequate contact with the liquids, heat removal and gas-liquid-solid fluid dynamics that facilitate formation of desired paraxylene crystals. The liquid product 102 rich in paraxylene crystals is withdrawn and subjected to other unit operations to obtain high purity paraxylene product. The direct contact crystallizer is designed to capture liquid and/or crystalline hydrocarbons entrained in the effluent nitrogen gas above the liquid/gas interface. The effluent nitrogen gas 104 in phase equilibrium with the crystallizer contents is warmed up to near ambient temperature in multi-stream heat exchanger 11. The resulting nitrogen gas 105 is treated in regenerative dual bed adsorption system 12 to remove the organic contaminants. A small quantity of nitrogen 109 is used to regenerate the off-line adsorption bed, resulting in vent stream 115. The purified nitrogen 106 is mixed with fresh nitrogen 110 (to compensate for losses) and the resulting nitrogen stream 107 is compressed for recycle. The compressor 14 is sized to deliver the recycle nitrogen 108 to the crystallizer at the required operating pressure, which could be in the range of 100 to 400 psia, preferably 150 to 300 psia, and more preferably 200 to 250 psia. Since the direct contact crystallizer design results in efficient gas-liquid-solid contact, the gas and slurry effluents leave the crystallizer at or near crystallizer operating temperature. Thus, the recycle nitrogen flow and its temperature at the crystallizer inlet are related by the crystallizer refrigeration duty. Colder nitrogen means relatively less nitrogen flow. The multicomponent refrigerant fluid closed loop comprising of streams 111, 112, 113 and 114, and associated process equipment is designed and operated to enable the cold nitrogen gas serve as the source of refrigeration in the crystallizer. In this particular example, cold nitrogen gas flow is calculated to supply half of the refrigeration by warming from −130° F. to −87° F., and the balance by warming to −58° F. Stream 111 is compressed to 205 psia in compressor 16, cooled against cooling water or air in the cooler 17. It is further cooled to −130° F. against warming stream 113, which results from isenthalpic expansion of stream 112 upon flowing through valve 18. Stream 113 serves as the primary source of refrigeration for delivering cold nitrogen gas to the crystallization application. Warmed stream 114 is compressed and thus completes the closed loop. The electricity requirement was calculated as 537 kW. The electricity requirement for a comparable system using a conventional ethylene/propane cascade cycle to generate the refrigeration was calculated to be 634 kW. These results are summarized in Table 1.

TABLE 1

| | PRIOR ART | INVENTION |
|---|---|---|
| Cold Nitrogen T, F | −130 | −130 |
| Electricity, kWh/MMBtu Refrigeration Load | 634 | 537 |

Figure 2:
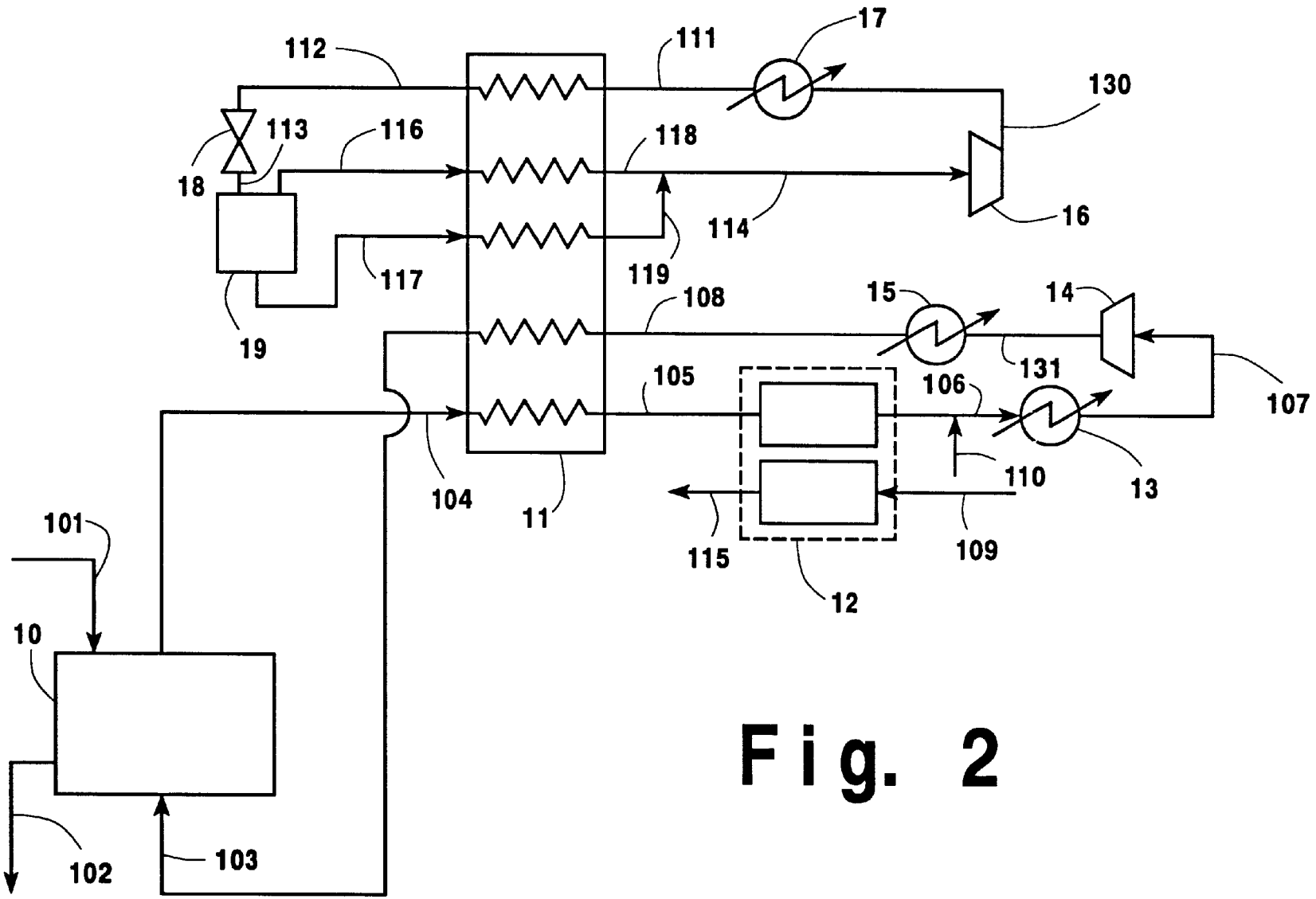
FIG. 2 is a simplified schematic representation of another preferred embodiment of the invention wherein the cooling compressed multicomponent refrigerant fluid is partially condensed.

FIG. 2 illustrates another embodiment of the invention employing a phase separator to counteract potential maldistribution. The numerals of FIG. 2 are the same as those of FIG. 1 for the common elements and these common elements will not be described again in detail.

Referring now to FIG. 2, refrigeration bearing multicomponent refrigerant stream 113 has both vapor and liquid phases and is fed to phase separator 19 wherein it is separated into its vapor and liquid phases. The vapor phase and liquid phase are passed separately from phase separator 19 in streams 116 and 117 respectively to separate passages of heat exchanger 11 wherein they are warmed and the liquid phase vaporized to cool the compressed multicomponent refrigerant fluid 111 and to provide refrigeration to the clean direct contact refrigerant 108. Streams 116 and 117 exit heat exchanger 11 as streams 118 and 119 respectively. These streams are combined to form stream 114 for passage to compressor 16 for further processing as previously described.

Figure 3:
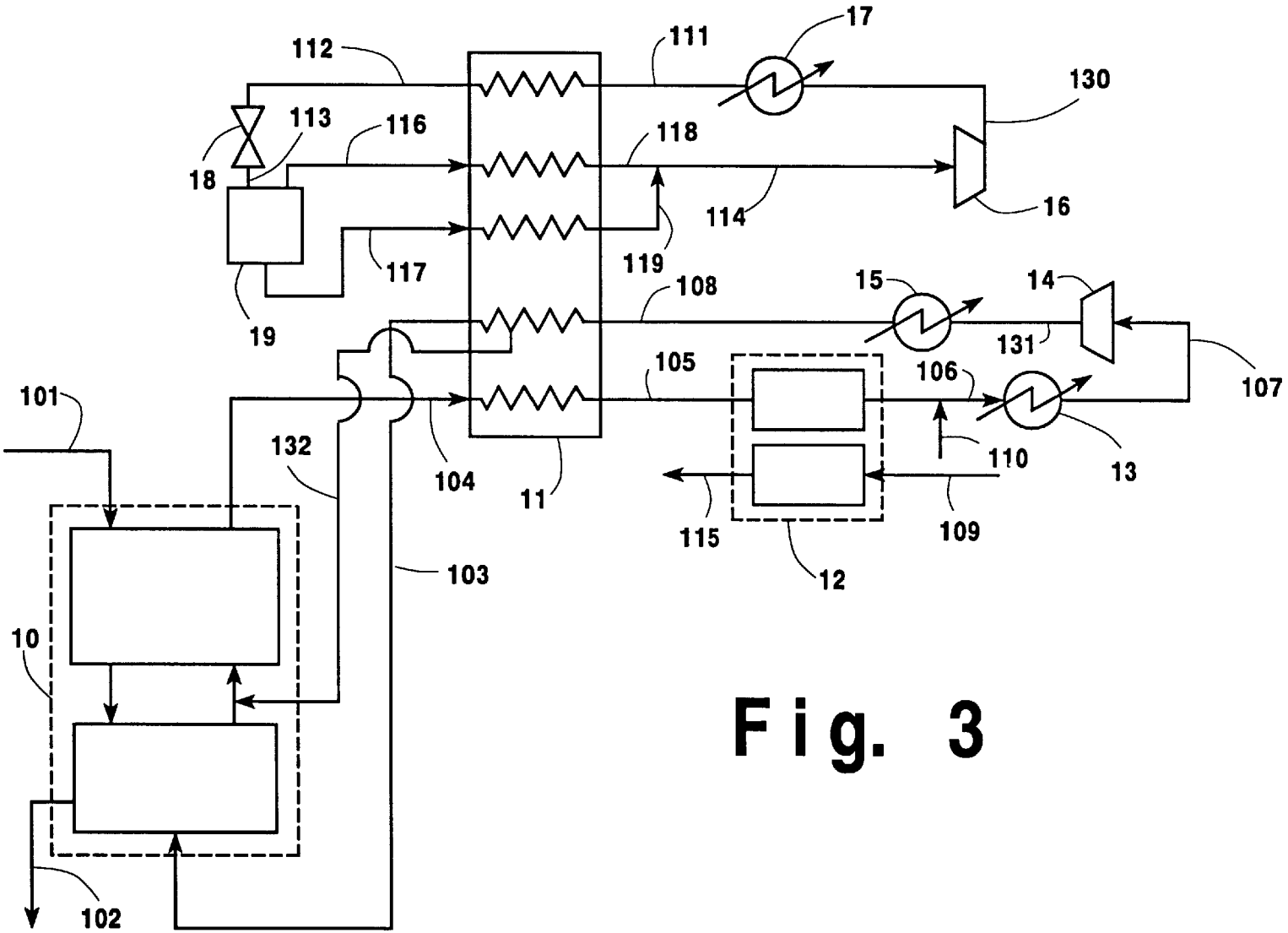
FIG. 3 is a simplified schematic representation of another preferred embodiment of the invention wherein the direct contact refrigeration is provided at two temperature levels.

FIG. 3 illustrates another embodiment of the invention similar to that illustrated in FIG. 2 but with the added aspect of providing the cold direct contact refrigerant to the heat source at two temperature levels. The numerals of FIG. 3 are the same as those of FIG. 2 for the common elements, and these common elements will not be described again in detail.

Referring now to FIG. 3, only a portion of clean direct contact refrigerant 108 completely traverses heat exchanger 11 to emerge therefrom as stream 103. Another portion 132 of stream 108 is withdrawn from heat exchanger 11 after only partial traverse thereof. Accordingly cold direct contact refrigerant in stream 132 is at a warmer temperature than is cold direct contact refrigerant in stream 103. These two different temperature cold direct contact refrigerant streams are provided to system or process 10 at different points to more optimally employ the refrigeration by direct contact with the heat source. The contaminant containing direct contact refrigerant from both streams 103 and 132 emerges from system or process 10 as stream 104 and is further processed as was previously described.

Although the invention has been described in detail with reference to certain preferred embodiments, those skilled in the art will recognize that there are other embodiments of the invention within the spirit and the scope of the claims.

What is claimed is:

1. A method for providing direct contact refrigeration comprising:

(A) compressing a multicomponent refrigerant fluid comprising at least two components from the group consisting of hydrocarbons having from 1 to 6 carbon atoms, fluorocarbons having from 1 to 6 carbon atoms, and inert gases;

(B) cooling the compressed multicomponent refrigerant fluid, expanding the cooled compressed multicomponent refrigerant fluid to generate refrigeration, and warming the refrigeration bearing multicomponent refrigerant fluid by indirect heat exchange with said cooling compressed multicomponent refrigerant fluid and also by indirect heat exchange with clean direct contact refrigerant to produce cold direct contact refrigerant;

(C) contacting the cold direct contact refrigerant with a heat source to cool the heat source producing warmed direct contact refrigerant which contains contaminants from the heat source; and (D) treating the direct contact refrigerant to remove contaminants and to produce clean direct contact refrigerant for indirect heat exchange with the refrigeration bearing multicomponent refrigerant fluid.

2. The method of claim 1 wherein the multicomponent refrigerant fluid comprises only hydrocarbons.

3. The method of claim 1 wherein the multicomponent refrigerant fluid comprises only fluorocarbons.

4. The method of claim 1 wherein the direct contact refrigerant comprises nitrogen.

5. The method of claim 1 wherein the direct contact refrigerant comprises nitrogen and at least one noble gas.

6. The method of claim 1 wherein the expansion of the cooled compressed multicomponent refrigerant fluid is isenthalpic expansion.

7. The method of claim 1 wherein the expanded refrigeration bearing multicomponent refrigerant fluid is in both a vapor phase and a liquid phase.

8. The method of claim 7 wherein the expanded refrigeration bearing multicomponent refrigerant fluid is separated into vapor and liquid streams which are separately passed in indirect heat exchange with the cooling compressed multicomponent refrigerant fluid and the clean direct contact refrigerant.

9. The method of claim 1 wherein the cold direct contact refrigerant is provided at more than one temperature level for contact with the heat source.

10. The method of claim 1 wherein the heat source is associated with a direct contact crystallizer.

11. The method of claim 1 wherein the heat source is associated with an exothermic reactor.

12. The method of claim 1 wherein contaminants are removed from the direct contact refrigerant by adsorption onto adsorbent particles.

13. Apparatus for providing direct contact refrigeration comprising:

(A) a multicomponent refrigerant circuit comprising a compressor, a heat exchanger, an expansion device, means for passing multicomponent refrigerant fluid from the compressor to the heat exchanger, from the heat exchanger to the expansion device, from the expansion device to the heat exchanger, and from the heat exchanger to the compressor;

(B) a heat source, means for passing direct contact refrigerant to the heat exchanger, and means for passing direct contact refrigerant from the heat exchanger to the heat source;

(C) a cleaning device, means for passing direct contact refrigerant from the heat source to the heat exchanger and means for passing direct contact refrigerant from the heat exchanger to the cleaning device; and (D) means for passing direct contact refrigerant from the cleaning device to the heat exchanger.

14. The apparatus of claim 13 wherein the means for passing multicomponent refrigerant fluid from the expansion device to the heat exchange includes a phase separator.

15. The apparatus of claim 13 wherein the heat exchanger is a unitary piece.

16. The apparatus of claim 13 wherein the cleaning device is an adsorption unit.

17. The apparatus of claim 13 wherein the heat source is a crystallizer.

18. The apparatus of claim 13 wherein the heat source is a reactor.

* * * * *